US006486426B2

(12) United States Patent
Swanson

(10) Patent No.: US 6,486,426 B2
(45) Date of Patent: Nov. 26, 2002

(54) CONTACT ARRANGEMENT FOR ELECTRICAL POWER DISTRIBUTION SWITCH OR THE LIKE

(75) Inventor: Roy T. Swanson, La Grange, IL (US)

(73) Assignee: S&C Electric Co., Chicago, IL (US)

( * ) Notice: Subject to any disclaimer, the term of this patent is extended or adjusted under 35 U.S.C. 154(b) by 0 days.

(21) Appl. No.: 09/808,874

(22) Filed: Mar. 16, 2001

(65) Prior Publication Data

US 2002/0014397 A1 Feb. 7, 2002

Related U.S. Application Data

(60) Provisional application No. 60/190,652, filed on Mar. 20, 2000.

(51) Int. Cl.[7] ..... H01H 1/06
(52) U.S. Cl. ..... 200/275; 200/256
(58) Field of Search ..... 200/253–256, 200/275, 260

(56) References Cited

U.S. PATENT DOCUMENTS 1,988,687 A * 1/1935 Jackson ..... 200/166
2,732,468 A * 1/1956 Curtis et al. ..... 200/255
2,760,034 A * 8/1956 Kowalski et al. ..... 200/255
3,632,935 A * 1/1972 Stegmaier ..... 200/155 R
4,408,110 A * 10/1983 Ladet et al. ..... 200/263
5,947,269 A * 9/1999 Miyashita ..... 200/407

* cited by examiner

*Primary Examiner*—Michael Friedhofer
*Assistant Examiner*—Lisa N Klaus
(74) *Attorney, Agent, or Firm*—James V. Lapacek

(57) ABSTRACT

A contact arrangement is provided, e.g. of the type that functions as a wiping contact for a moving contact such as a pivotally mounted switch blade in an electrical power distribution switch. The contact arrangement in an illustrative embodiment includes spaced apart contact members that are biased toward each other to define predetermined contact pressure/force characteristics with respect to the interposed moving contact. The contact members in a preferred embodiment include predetermined contact areas and predetermined structural features to minimize deformation due to magnetic forces experienced in the presence of high currents. The structural features are also arranged to define current paths that increase the contact pressure. In a particular embodiment the contact areas are formed on the contact members so as to minimize the size of the moving contact.

6 Claims, 3 Drawing Sheets

CONTACT ARRANGEMENT FOR ELECTRICAL POWER DISTRIBUTION SWITCH OR THE LIKE

This application claims the benefit of U.S. Provisional Application No. 60/190,652 filed on Mar. 20, 2000.

BACKGROUND OF THE INVENTION

1. Field of the Invention

The present invention relates generally to electrical switch contact arrangements and power distribution switches and more particularly to an improved wiping contact arrangement for use with a pivotally mounted switch blade.

2. Description of Related Art

Various switches and operating mechanisms are shown in the following U.S. Pat. Nos. 2,918,556, 3,563,102; 3,676,629; 3,845,433; 4,169,973; 4,293,834; 4,398,072, 4,484,046; 5,140,117; 5,224,590; 5,504,293 and 5,772,009. For example, these patents disclose various stationary and wiping contact arrangements. While these contact arrangements may be generally suitable for their intended use, it is always desirable to provide simplified structures with improved operating characteristics.

SUMMARY OF THE INVENTION

Accordingly, it is a principal object of the present invention to provide an improved contact arrangement for electrical switches having improved operating characteristics.

It is another object of the present invention to provide a wiping contact arrangement for a moving contact with improved contact pressure during high currents.

These and other objects of the present invention are achieved by a contact arrangement, e.g. of the type that functions as a wiping contact for a moving contact such as a pivotally mounted switch blade in an electrical power distribution switch. The contact arrangement in an illustrative embodiment includes spaced apart contact members that are biased toward each other to define predetermined contact pressure/force characteristics with respect to the interposed moving contact. The contact members in a preferred embodiment include predetermined contact areas and predetermined structural features to minimize deformation due to magnetic forces experienced in the presence of high currents. The structural features are also arranged to define current paths that increase the contact pressure. In a particular embodiment the contact areas are formed on the contact members so as to minimize the size of the moving contact.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
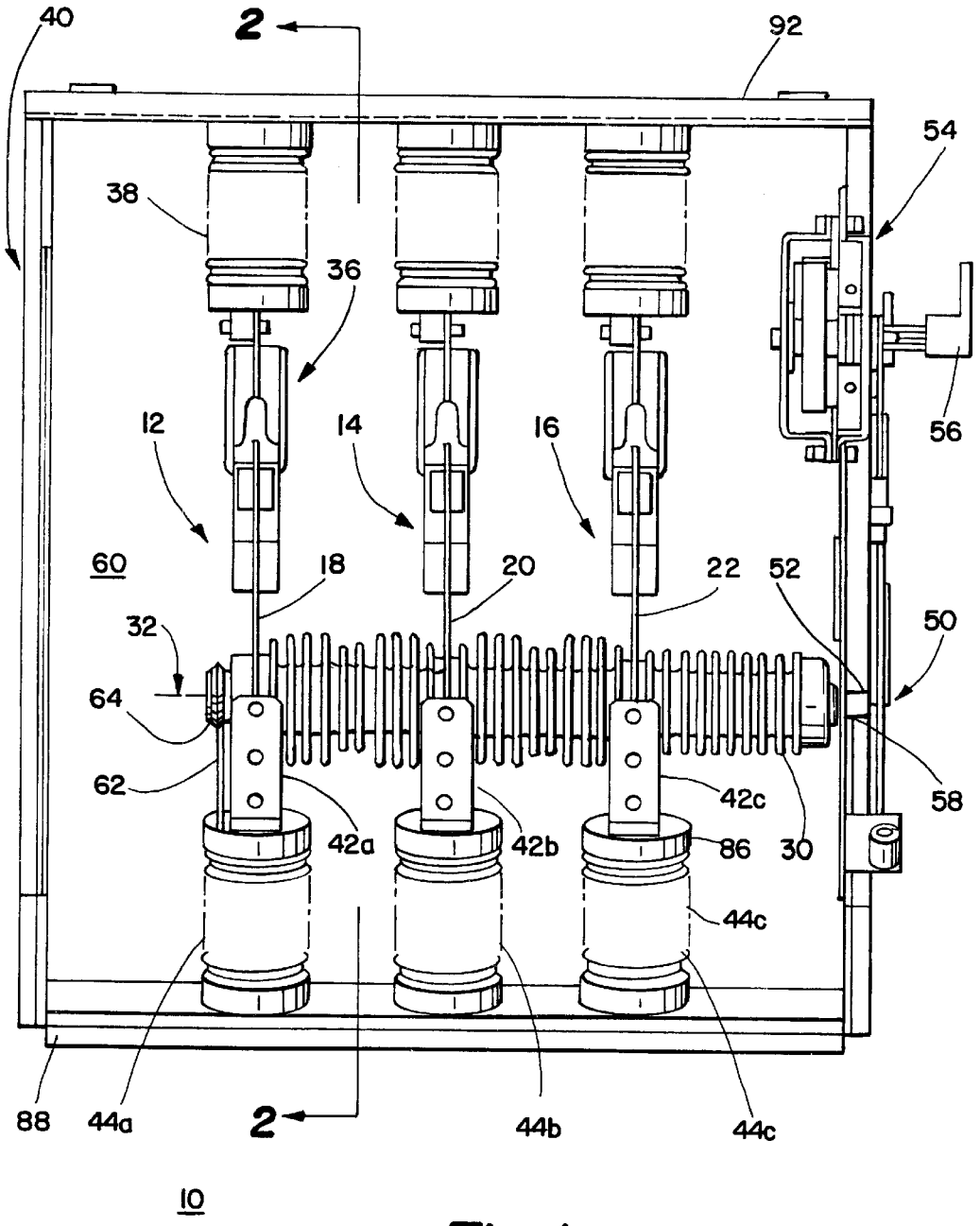
FIG. 1 is a front elevational view of a switch utilizing a contact arrangement in accordance with the principles of the present invention.
Figure 2:
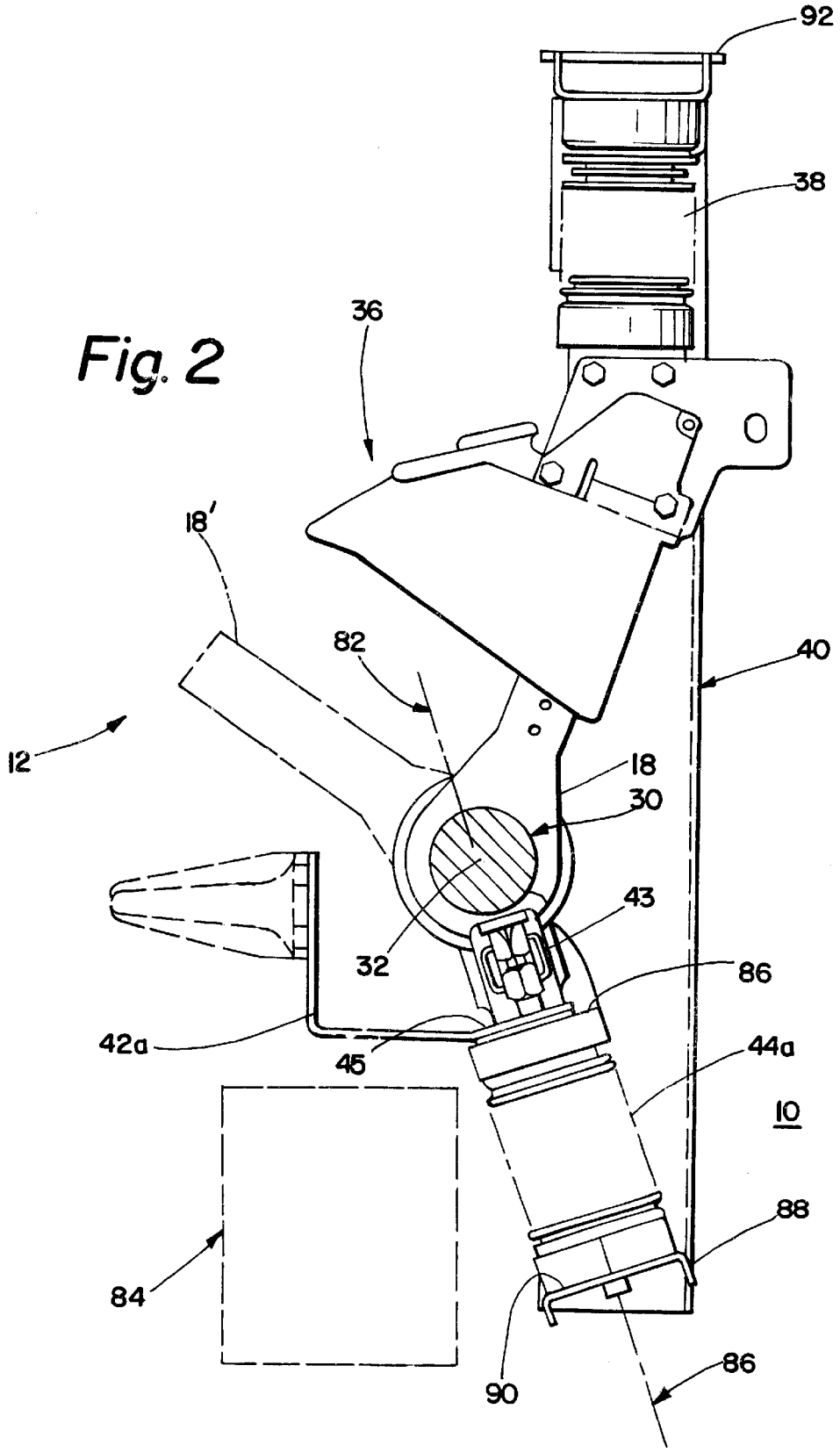
FIG. 2 is a view, partly in section, taken generally along the line 2–2 of FIG. 1.
Figure 3:
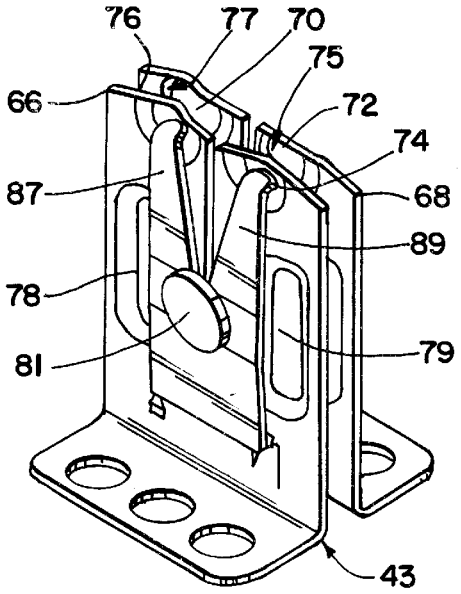
FIG. 3 is a perspective view of the contact arrangement of FIGS. 1 and 2.
Figure 4:
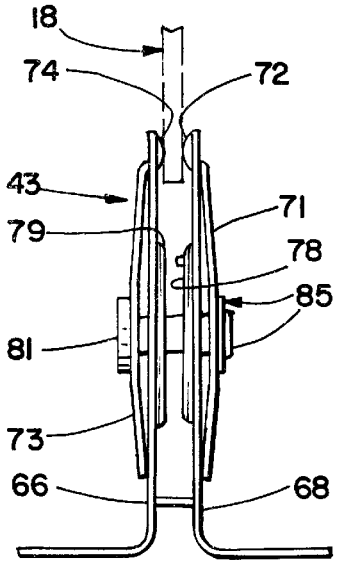
FIG. 4 is a front elevational view of the contact arrangement of FIG. 3.
Figure 7:
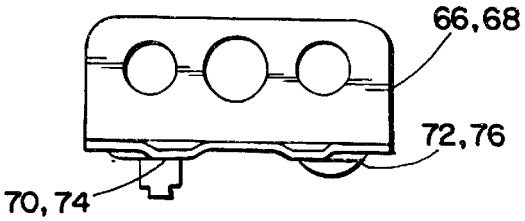
FIG. 7 is a top plan view of the contact member of FIG. 5.
Figure 8:
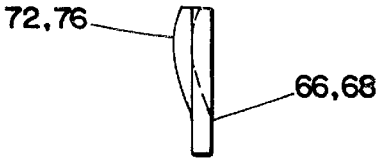
FIG. 8 is an enlarged partial view of the contact member of FIG. 6.
Figure 5:
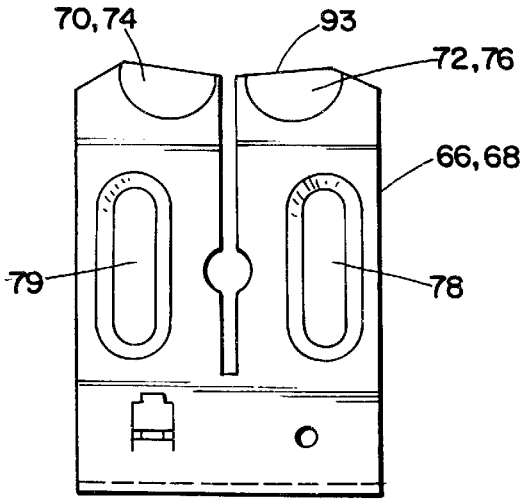
FIG. 5 is a front elevational view of a contact member of the contact arrangement of FIGS. 3 and 4.
Figure 6:
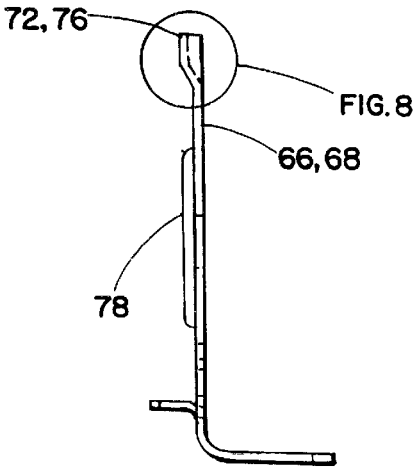
FIG. 6 is right-side elevational view of the contact member of FIG. 5.

Referring now to FIGS. 1 and 2, the contact arrangement of the present invention will be described in conjunction with a power distribution switch 10 that includes multiple switch poles, e.g. three switch-pole assemblies 12, 14 and 16 as illustrated in the specific embodiment of FIG. 1. In this specific illustrative embodiment, the three switch-pole assemblies 12, 14 and 16 are operable between open and closed positions via pivotally mounted switch blades 18, 20 and 22 respectively, the closed position being shown in FIGS. 1 and 2, the open position shown in phantom in FIG. 2 at 18'. The switch blades 18, 20 and 22 are carried by an operating member 30 that is mounted for pivotal movement about an axis 32 that is substantially horizontal in the illustrative arrangement. Each of the switch-pole assemblies 12, 14 and 16 includes a stationary contact assembly 36 having arc-extinguishing capabilities in the specific embodiment where the switch 10 is a load-interrupting switch. The stationary contact assemblies 36 are each supported by an insulator 38 affixed to a frame 40 of the switch 10. The switch blades 18, 20 and 22 are each electrically connected to a respective lower contact terminal 42 via a sliding contact arrangement provided by lower contact assemblies 43 (FIG. 2) carried by the lower contact terminal 42. The sliding contact feature is also commonly referred to as a wiping contact. The lower contact terminals 42 are supported with respect to the frame 40 at planar portions 45 (FIG. 2) via insulators 44, for example, lower contact terminals 42*a, b* and *c* supported by respective insulators 44*a, b* and *c*.

The operating member 30 is rotated via a linkage 50 that connects an operating shaft 52 of the operating member 30 to be driven by an operating mechanism 54. The operating mechanism 54 is a stored energy device that is operated by a handle 56. The operating member 30 is rotatably mounted at a first end by the operating shaft 52 within a bearing 58. The opposite end of the operating member 30 includes a cylindrical bearing surface 64 that is pivotally supported at 60 via a support bracket 62 that is affixed to the support insulator 44. In a specific embodiment, the support bracket 62 is conductive. Thus, in operation, the support bracket 62 is energized at the same potential as the lower contact terminal 42.

It has been found desirable to mount the contact assemblies 43 so as to be aligned along the path between the center 32 of the operating member 30 and the base of the support insulators 44. In that way any movement of the insulators that may be caused by extreme loading results in movement of the contact assemblies 43 more nearly along the circumferential surface contact of the switch blades 18, 20 and 22. For example, different mounting orientations result in movement of the contact assemblies in a direction that tends to separate the contact assemblies from the switch blades 18, 20 and 22.

In accordance with additional aspects of the present invention, the insulators 44 supporting the operating member 30 are oriented such that their longitudinal axes, e.g. 80, are aligned with respect to the radial axis 82 of the operating member 30 as seen in FIG. 2 but not directly below the operating member 30. This orientation provides for preservation of space in the cable termination area, generally referred to at 84 beneath and to the rear of the lower contact terminals 42, while also simplifying the mounting of the lower contact terminals 42 and the lower contact assemblies 43 to the support insulators 44. Specifically, this permits mounting of the planar portions 45 of the lower contact terminals 42 and the lower contact assemblies 43 directly to an upper planar surface 86 of the support insulators 44 which simplifies the shape and fabrication of the lower contact terminals 42 and the lower contact assemblies 43 and avoids the need for additional parts to mount these components. As seen in FIG. 2, a lower mounting member 88 of the frame 40, to which the lower planar surfaces 90 of the insulators 44 are mounted, is tilted or inclined with respect to the generally planar configuration of the switch 10 and the frame 40 and an upper mounting member 92 of the frame 40 to which the upper support insulators 38 are mounted. The generally planar configuration of the switch 10 and the frame 40 are typically arranged vertically for application in metal-enclosed gear.

Referring now additionally to FIGS. 3–8, the lower contact assemblies 43 include spaced apart contact members 66, 68 that define one or more contact gaps, e.g. two contact gaps 75, 77 in an illustrative embodiment, via the provision of formed structural protusions 70, 72, 74 and 76 that are partial, generally spherical convexities in a specific embodiment, the formed structural protusions 70, 72, 74 and 76 also defining and being referred to as generally circular contact areas. In the illustrative embodiment, the contact members 66, 68 are bifurcated at 67 such that the contacts within the contact gaps 75, 77 are each independent of the other. The contact members 66, 68 are biased toward one another by a biasing arrangement, e.g. a spring member 71, 73 in a specific embodiment assembled to each bias a respective contact member 66, 68. For example, in a specific arrangement, the lower contact assembly 43 is assembled via a fastening pin 81, e.g. a rivet, and a washer 83 being retained under the widened end 85 of the pin 81. In an illustrative embodiment, each of the spring members 71, 73 includes biasing finger members 87, 89 that are arranged to respectively bias the contact protusions 70, 72, 74 and 76. When assembled, the spring members 71, 73 bias the contact members 66, 68 so as to provide a predetermined contact force or pressure on the switch blade 18, e.g. in the range of 20–30 pounds at a contact gap of ⅛ of an inch in a specific embodiment for a medium voltage switch (e.g. rated at 15 or 25 kV, and continuous current of 600 amperes and 20,00 to 40,000 amperes fault closing). This contact arrangement relies on magnetic effects to increase the contact forces or pressures during high current faults. It will be understood to those skilled in the art that not maintaining adequate contact pressure can result in deterioration or destruction of the contact surfaces.

In accordance with important aspects of the present invention, the contact members 66, 68 include structural provisions (described in more detail hereinafter) that strengthen the contact members 66, 68 so as to resist deformation due to magnetic forces experienced during high currents. At high currents, magnetic effects increase the contact pressure. However, the forces exerted by the magnetic effects is limited by the strength of the contact members 66, 68. If the contact members are not of sufficient strength, the contact members 66, 68 merely bend instead of increasing the force of the contact pressure. On the other hand, if the contact members 66, 68 are of sufficient strength, the increased forces are applied uniformly along each contact member 66, 68 such that the maximum forces can be applied at the contact gaps 75, 77 to increase the contact pressure. Accordingly, bending of the contact members 66, 68 is undesirable since it reduces the maximum contact pressure; in extreme cases, the contact members 66, 68 being sufficiently deformed to the extent of coming in contact with each other. In a preferred embodiment, these structural provisions also aid in defining the current paths through the contact members 66, 68 to the lower contact terminal 42 so as to increase the contact pressure. In a specific illustrative embodiment, the structural provisions include formed structural elements 78, 79 that define shapes that depart from the plane of the contact members 66, 68 so as to strengthen the contact members 66, 68 from bending and the like. It has also been found that these structural elements 78, 79 and their placement on the contact members 66, 68 increase contact pressure in the contact gaps at 75, 77 due to the parallel current paths in the contact members 66, 68 in the vicinity of the structural elements 78, 79 being closer together (i.e. compared to the absence of the structural elements 78, 79 in the directions formed). In accordance with additional aspects of the present invention, the contact protusions 70, 72 74 and 76 are formed in a shape that defines the contact surface along the leading or top edge of the contact members 66, 68 such that there is minimal space from the center 91 of the contact areas 70, 72, 74 and 76 to the edge 93 of the contact members 66, 68, this arrangement also being characterized as truncating or cutting back of the generally circular contact areas 70, 72, 74 and 76. With this arrangement, the radius of the switch blade 18 may be minimized in that the truncated shape of the contact areas 70, 72, 74 and 76 permits the contact to be made nearer the center of the switch blade 18 and the operating member 30, e.g. the axis 32.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. A contact arrangement for use in an electrical switch comprising:

at least two contact members being generally planar and spaced apart, each of said contact members having a contact area that is defined by a truncated portion of a generally circular shape, the truncation being arranged along an edge of each of said contact members;

first means for biasing said contact members toward each other to define a contact gap intermediate said contact members; and second means for structurally strengthening said contact members to reduce bending or deformation of said contact members and for increasing the magnetic forces between said contact members.

2. The contact arrangement of claim 1 wherein said contact members each define a plane and wherein said second means comprises formed shapes that depart from the plane of said contact members and extend toward each other.

3. The contact arrangement of claim 2 wherein each of said contact members is mounted at one end thereof opposite a second end at the contact gap and defining a length in a first direction between the first end and the second end.

4. The contact arrangement of claim 3 wherein each of said contact members defines a width and includes two of said formed shapes arranged across the width thereof.

5. A contact arrangement on a contact member having a contact area that is defined by a truncated portion of a generally circular shape, the truncation being arranged along an edge of said contact member.

6. A contact arrangement for use in an electrical switch comprising:

at least two contact members being generally planar and spaced apart, each of said contact members having a contact area that is defined by a truncated portion of a generally circular shape, the truncation being arranged along an edge of each of said contact members;

first means for mounting said contact members at one end of each thereof and biasing said contact members toward each other to define a contact gap intermediate said contact members, a length of each of said contact members being defined between said one end and said contact gap; and second means for structurally strengthening said contact members to reduce bending or deformation of said contact members, said second means comprising structural elements being formed in said contact members, said structural elements being defined along the length of each of said contact members and in a direction so as to extend toward one another.

* * * * *